US009995065B2

(12) United States Patent
Witte et al.

(10) Patent No.: US 9,995,065 B2
(45) Date of Patent: Jun. 12, 2018

(54) DOOR HANDLE ASSEMBLY FOR A MOTOR VEHICLE

(71) Applicant: Huf Huelsbeck & Fuerst GmbH & Co. KG, Velbert (DE)

(72) Inventors: Martin Witte, Ahaus (DE); Andreas Beck, Bochum (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 11 days.

(21) Appl. No.: 15/014,860

(22) Filed: Feb. 3, 2016

(65) Prior Publication Data

US 2016/0230429 A1 Aug. 11, 2016

(30) Foreign Application Priority Data

Feb. 6, 2015 (DE) ..... 10 2015 101 733

(51) Int. Cl.
*E05B 81/64* (2014.01)
*E05B 85/16* (2014.01)
(Continued)

(52) U.S. Cl.
CPC ..... *E05B 85/16* (2013.01); *E05B 81/64* (2013.01); *E05B 81/76* (2013.01); *E05B 17/10* (2013.01)

(58) Field of Classification Search
CPC ..... E05B 17/10; E05B 85/16; E05B 81/64; E05B 81/76
See application file for complete search history.

(56) References Cited

U.S. PATENT DOCUMENTS 7,331,618 B2 * 2/2008 Jooss ..... E05B 81/78 292/336.3
8,454,062 B2 * 6/2013 Rohlfing ..... E05B 81/78 292/336.3
(Continued)

FOREIGN PATENT DOCUMENTS

DE 10 2012 106 526 A1 1/2014
DE 10 2013 212 083 A1 1/2014
(Continued)

OTHER PUBLICATIONS

European Search Report of EP 16 15 2966 dated Jun. 24, 2016, 9 pages.

*Primary Examiner* — Matthieu F Setliff
*Assistant Examiner* — Thomas L Neubauer
(74) *Attorney, Agent, or Firm* — Fay Sharpe LLP

(57) ABSTRACT

A vehicle door handle assembly includes an actuating element, which is actuated by a user gripping the handle from behind. The actuating element protrudes outward through a recess in the handle from an inner cavity through a wall of the handle over an outer contour of the handle. The actuating element is movable through the recess in the direction of the handle inner cavity against an elastic restoring force. The actuating element is at least in sections made of a metal. Located inside the handle is a stationary electric module with an inductive distance sensor so that when the actuating element moves, the distance of the actuating element in relation to the inductive distance sensor changes. An evaluation unit detects the signals of the inductive distance sensor, detects an actuation as a function of the signals, and provides an output signal.

10 Claims, 3 Drawing Sheets

(51) Int. Cl.
*E05B 81/76* (2014.01)
*E05B 17/10* (2006.01)

(56) References Cited

U.S. PATENT DOCUMENTS

| | | | | |
|---|---|---|---|---|
| 8,919,154 | B2 * | 12/2014 | Kim | D06F 35/006 68/3 R |
| 8,946,936 | B2 * | 2/2015 | Okada | E05B 81/78 296/146.1 |
| 2011/0140479 | A1 * | 6/2011 | Okada | E05B 81/78 296/146.1 |

FOREIGN PATENT DOCUMENTS

| | | | |
|---|---|---|---|
| DE | 20 2014 105 458 | U1 | 11/2014 |
| EP | 0 584 499 | A1 | 3/1994 |
| EP | 1 167 666 | A1 | 1/2002 |
| EP | 1 460 204 | A2 | 9/2004 |
| EP | 1 763 048 | A1 | 3/2007 |
| EP | 2 088 267 | A2 | 8/2009 |

* cited by examiner

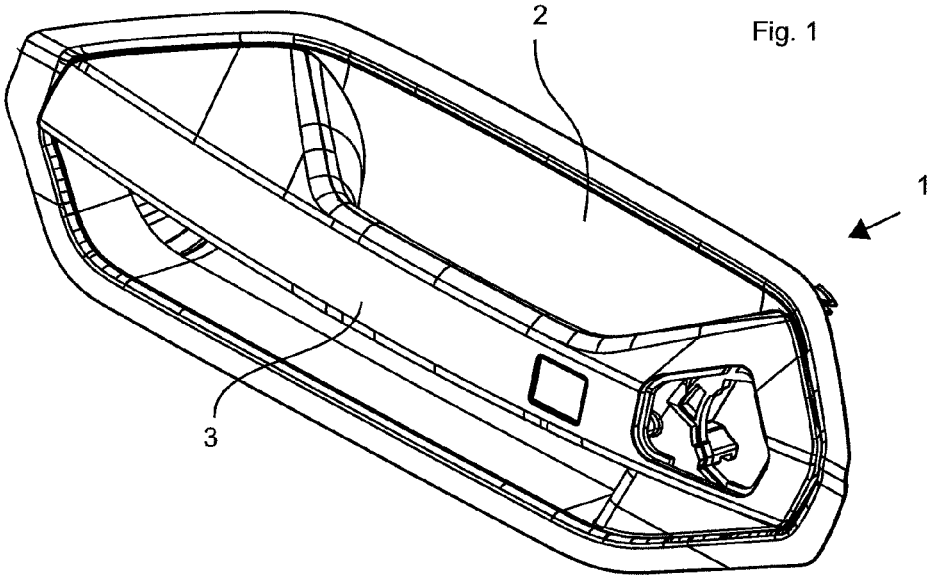
Fig. 1
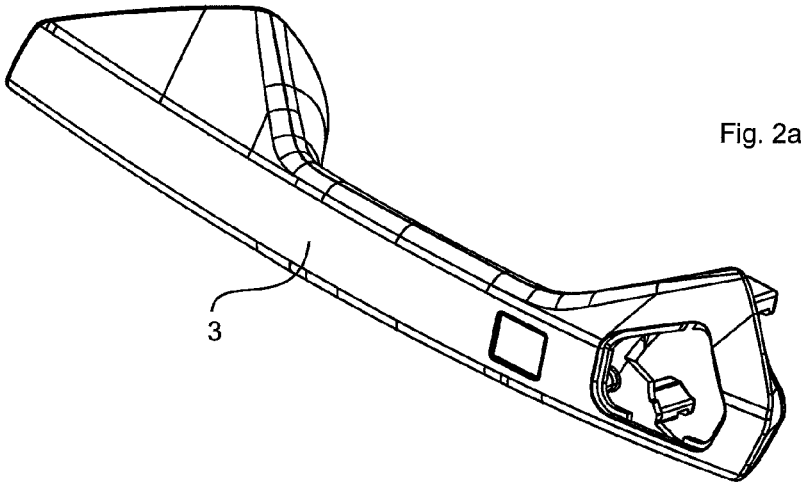
Fig. 2a
Fig. 2b
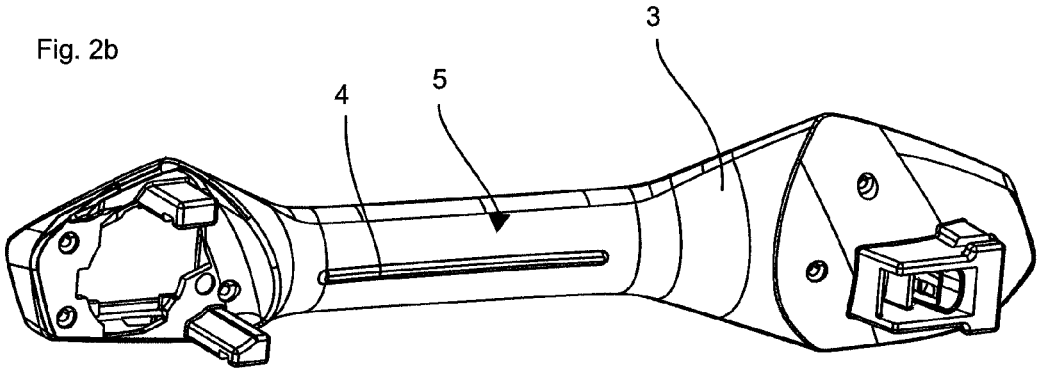

DOOR HANDLE ASSEMBLY FOR A MOTOR VEHICLE

BACKGROUND

The invention relates to a vehicle door handle assembly. The invention in particular relates to an outer door handle assembly with a sensor device for detecting actuation. The vehicle door handle assembly comprises a handle, wherein at a side of the handle to be grasped from behind is arranged an actuation element, which can be actuated by an operator when grasping the handle.

Door handles for motor vehicles are available in various designs. We can distinguish in particular door handles with a movable handle from those with a fixed handle. In a movable handle design, a handle part of the door handle assembly to be grasped by the user from underneath or from behind is pivoted or translationally moved by force and this movement is transferred to a lock device in the door to be actuated. In a fixed door handle design, the handles are arranged largely immovable in relation to the door. In combination with such fixed door handles are usually used electrically controlled door locks, which are carried under the name of "e-latch". Such door locks are disclosed, for example, in EP 0 584 499 A1. In fixed door handles, no continuous mechanical effect chain of the door handle is formed on a door lock. Instead, the door lock is electrically actuated in dependence on a detected actuation so that mechanical hardware can be reduced and cost and weight savings can be achieved.

There exist numerous differences in the way the actuation of a fixed door handle is detected. For this purpose, switches or capacitive sensors or deformation sensors can be used in the vehicle door handle, which detect the deformation of the door handle itself.

However, the operation of such fixed door handles requires either a complicated and costly sensor or it is not reliable in its detection in the desired extent. The object of the invention is to provide improved operator identification for door handles on motor vehicles.

BRIEF SUMMARY

This object is achieved by a vehicle door handle assembly comprising a sensor device according to the features of claim 1.

The inventive door handle includes a handle, which can be designed to be grasped all around, from underneath or from above. In any case, at an area the handle is grasped from behind to exert a force required to open the door. In this area to be grasped from behind is arranged an actuating element according to the invention. The actuating element is formed such that it is partially passed through a recess in the handle from the inside outwards, i.e. a part projects into an internal cavity of the handle and a part of the actuating element projects outward from the handle and at least slightly protrudes beyond the outer contour. The extent of the extension in which the actuating element protrudes outwards beyond the outer contour of the handle can be very small. For example, a few tenths of a millimeter are sufficient so that an operator hardly feels this rise and does not perceive it as disturbing.

Inside the handle, the actuating element is movably arranged so that for actuation, the actuating element can be passed through the recess of the handle in the direction of the interior of the handle. An elastic restoring force is provided to move the actuator back into the original position when the exertion of force stops. Under the term movable must be understood in this context that a shift, tilting or deformation of the actuator is allowed in the direction of the interior space. Very small ranges of movement or movement paths are sufficient. So, too, as the handle protrudes outward beyond the outer contour of the door handle, a deformation path, deformability or similar of only fractions of millimeters can be sufficient.

Given this extremely small spaces of movement, it is clear that the actuator is not a switch with a noticeable pressure point, but rather a device which passes the actuating element into the interior of the handle when pressure force is exerted in the form of a small deformation or displacement.

The actuator is also formed at least partially by a metallic material. This metallic material is mounted in the interior region of the handle on the actuating element, laminated, sprayed, painted on it, or the entire actuating element is mixed with a metallic material, for example a metallized plastic. This metallic material is essential, because an electrical assembly having at least one inductive distance sensor is arranged in the interior of the handle. Inductive distance sensors detect changes in the position of metallic objects in relation to the distance sensor with high precision. When operated, the metallic material of the actuating element moves in relation to the distance sensor, because the distance sensor is installed stationary within the handle. Thus, a relative movement between the actuating element and the distance sensor occurs as soon as the actuating element moves in the direction of the interior space or is brought by the restoring force to the original position. The actuating element is used accordingly to impart a change in the distance or position between the metallic components of the actuating element and the inductive distance sensor, and to detect this change in distance.

In this way, even small forces and thus operating routes that occur in deformation or displacement of the actuating element can be detected and evaluation circuit coupled with the inductive distance sensor is capable to undoubtedly identify an actuation of the door handle.

The thus formed door handle is very robust, because the handle need not be completely deformable and only the mechanical actuating element is exposed to the exterior, and in addition, the electronic components can be installed protected inside the handle or optionally be designed in an encapsulated form. The actuating element itself has no necessarily required electrical components; it must be merely ensured that metallic regions are formed in the material or on the material which are detected by the distance sensors in the door handle. In this way, the mechanical components are disengaged by the actual detection. In a further development of the invention, the actuating element is made from a plastic, which is partially covered with a metallic layer.

In this design, the actuating element can be integrated on the outside, i.e. on the side which a user contacts, in the design of the grip surface so that, if at all, only small differences in perception are perceived upon touch. Inside can be applied a metallic layer in the form of a sheet or foil, because this area is located in the detection range of inductive distance sensors. Compared to a fully metallic or partially metallic design of the actuating element, this design can also save in terms of weight.

In a preferred embodiment of the invention, the electrical assembly arranged in the interior of the door handle is formed with a printed circuit board, on which is formed the inductive distance sensor, wherein the circuit board is accommodated in a holder. The actuating element is movably coupled to the holder.

In this configuration, the electronic component is accommodated in the holder and the movable actuating element is coupled with this holder so that a coherent unit is formed. For example, there can be provided a receptacle with an opening, into which the printed circuit board is inserted and the actuating element can be secured on the holder with spring elements.

It is particularly preferred if the actuating element is formed integrally with the holder. In particular, the design of the actuating element as a deformable projection on the holder or receptacle for the electrical assembly is advantageous because then the holder with the actuating element can be formed in one molding process, after which the actuating element can be coated with a metallic coating in the form of a film.

It is advantageous if the circuit board is potted in the holder with a sealing compound. Through the opening in the handle, within which the actuating element is movable when force is exerted, environmental influences can penetrate into the interior of the handle. Potting the electrical components provides protection of the electronic components and in particular of the inductive distance sensor, and ensures a reliable function of the system.

The inventive door handle is also formed in one embodiment in such a way that the actuating element is formed as an elongate element extending along the longitudinal axis of a handle. A plurality of inductive distance sensors are arranged along the longitudinal extension in the handle and detect the approach of various sections of the actuating element. If several inductive distance sensors are used to monitor different sections of the actuating element, there can for example be provided a functionality, which detects a unilateral operation of the actuating element. In this way, the actuating element fulfills several operating functions, depending on which section of the actuating element is operated and which inductive distance sensor detects an actuation.

As already described above, the actuating element can basically consist of an integral structure which partially comprises metallic components, such as a plastic with metal particles. On the other hand, the actuating element can also be formed in a multipart design. A base body made of a plastic can be formed with a coating or a slipped-on component or another section of a metallic material. For example, a first section protruding from the handle can be formed of plastic, and a second section located inside the handle can be formed of a metallic material. In a further development of the invention, this second section formed of the metallic material with spring shackles tongues which are supported inside the handle. In this way, the restoring element itself will provide the required restoring force to move the actuating element back into its initial position after the operating force ceases to be exerted.

The partial formation of the actuating element of a plastic material also offers further possibilities for the design. In particular, in a further development of the invention the material of the actuating element can be used as a light conductor to emit light from a light source located in the interior of the handle to the outside. Since the actuating element in the rear area is facing the handle, an operating area can be backlit for the user so that the grip field can be illuminated. One and the same element then serves different purposes, namely at the same time to conduct light and to actuate.

BRIEF DESCRIPTION OF THE DRAWINGS

The invention will now be explained in more detail with reference to the accompanying figures.

FIG. 1 shows a door knob assembly according to a first embodiment, with a handle and a recessed grip in a perspective view;

FIG. 2*a* shows the separate handle according to the first embodiment in a first perspective view;

FIG. 2*b* shows the separate handle according to the first embodiment in a second perspective view;

DETAILED DESCRIPTION

Figure 3:
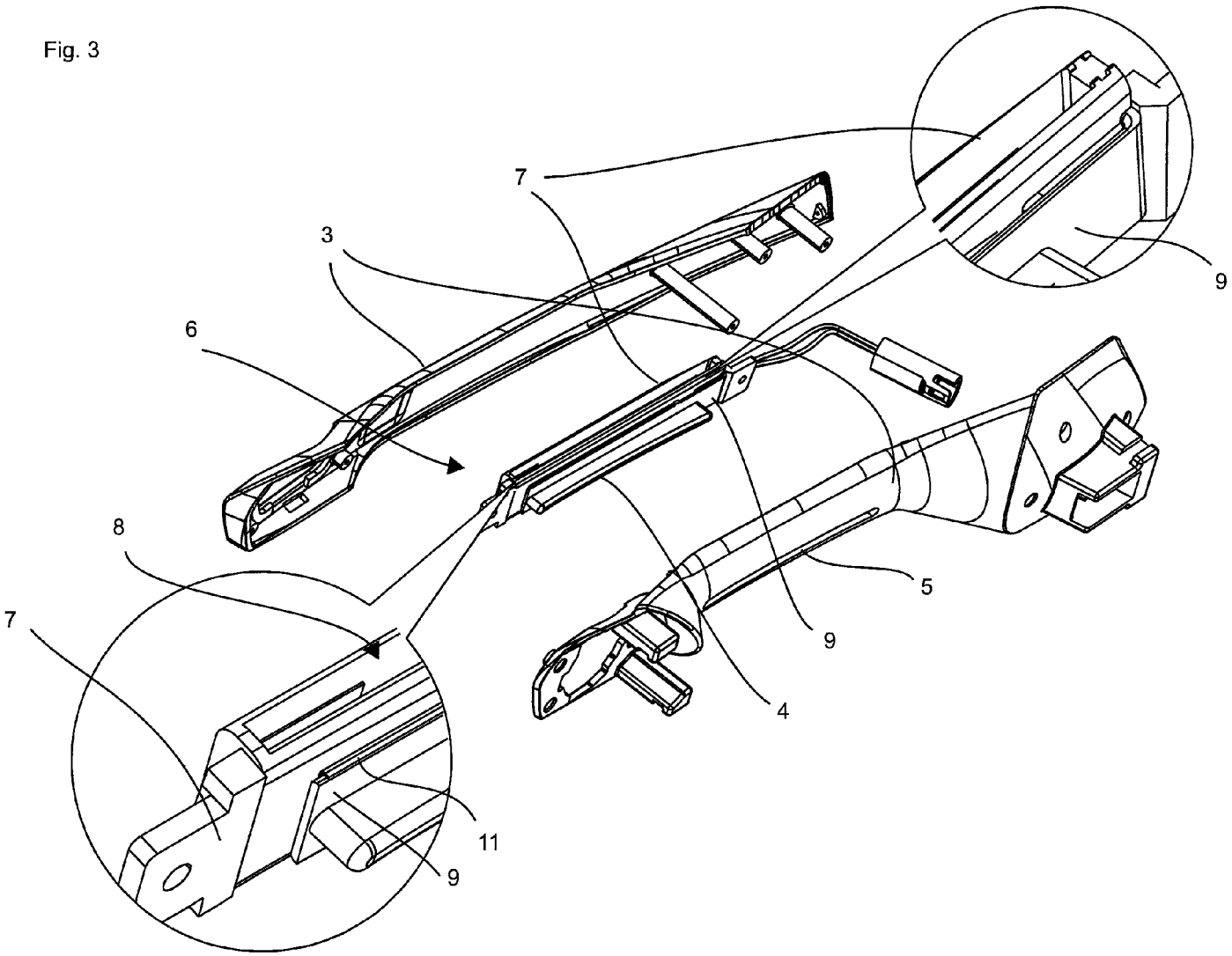
FIG. 3 shows an exploded view of the handle with partial magnifications.

FIG. 1 shows a door handle assembly 1 with a handle grip 2 and a handle 3. The handle 3 can be grasped from the back for door operation in a range between handle grip 2 and handle 3. In this example, the handle 3 has a recess for a lock cylinder and a further actuating element, but these components are not essential for the invention.

In FIG. 2*a*, the handle 3 is shown isolated from the handle grip 2.

In FIG. 2*b*, the handle 3 is shown in a view from behind. In this view, a section 4 of the actuating element is visible, which protrudes through an opening 5 in the handle 3. When a user grabs the handle 3 from behind in the area between the handle 3 and the handle grip 2, his hand involuntarily comes to rest on the actuating element 4 and exerts a force on the actuating element 4 when the handle 3 is pulled.

FIG. 3 shows the handle 3 in an open state. In this embodiment, the handle 3 is formed by two housing shells, whereby the opening 5 is formed in one of the housing shells. In the internal cavity of the handle is formed an operating unit 6. The operating unit comprises a receptacle or holder 7 made of plastic. In a cavity of this receptacle or holder 7 is formed a circuit board 8. On this board are arranged inductive distance sensors as surface-mountable components facing with their detection area the tongue 9.

At the receptacle 7 is also integrally formed a tongue 9. On the tongue 9 is in turn integrally formed the projection 4 shown in the previous figures, which protrudes through the aperture 5 of the handle. The projection 4 is touched by the user, and when force is applied, the tongue 9 slightly deformed along with the projection 4 in the direction of the receptacle 7. The metallic coating 11 is provided to trigger the inductive distance sensors arranged on the circuit board 8 or to detect the distance of this coating 11 from the inductive distance sensors. In this embodiment, therefore, the actuating element is made up of several components, namely the components 9, 4 and 11.

Figure 4:
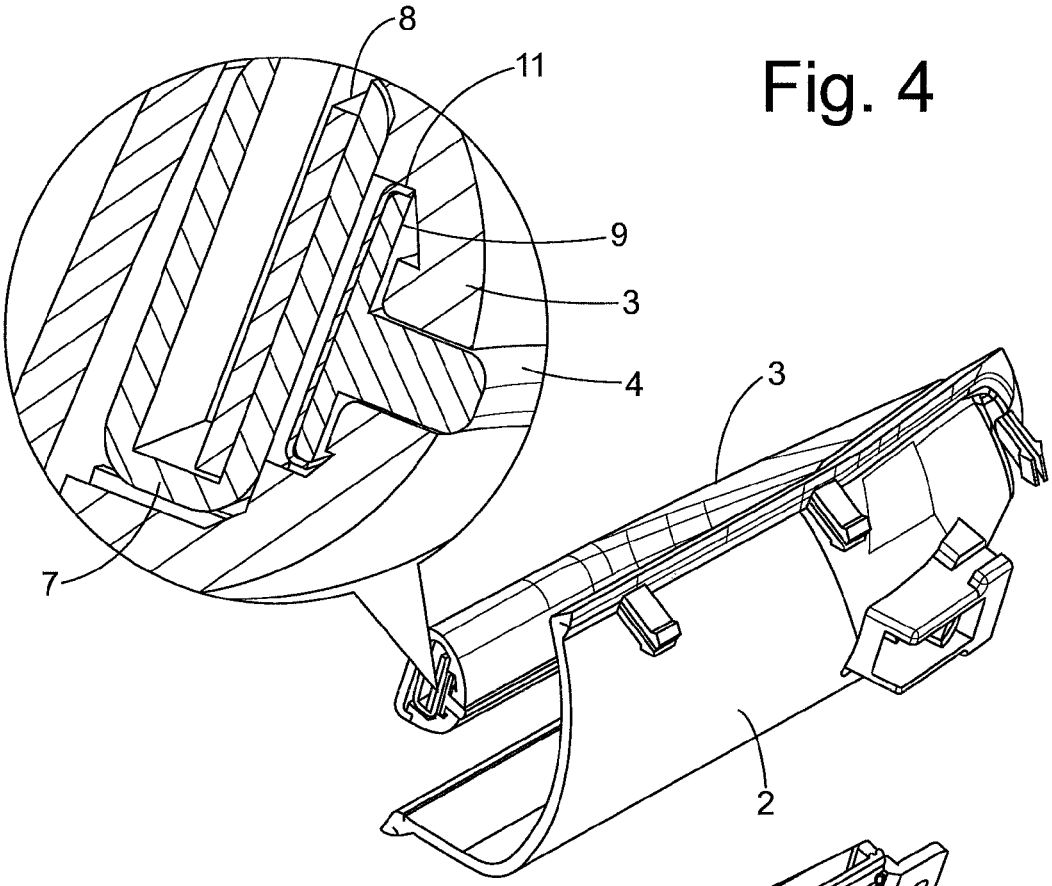
FIG. 4 shows a sectional view of the door handle assembly according to the first embodiment.

FIG. 4 shows a sectional view of the handle with components arranged therein in the assembled state. It becomes clear that the projection 4 projects through the outer wall of the handle 3 and slightly protrudes over the outer contour of the handle 3. In the illustration are visible the tongue 9 and the slipped-on metallic part 11. The metallic sleeve 11 is located opposite to the board 8 with the inductive distance sensors arranged thereon; however, it is separated from them by the receptacle 7. Tongue 9 and cover 11 are in their normal position spaced from the receptacle 7, wherein an air gap is formed between the part 11 and the receptacle 7.

Movement of the components 9, 4 and 11 causes a change of distance of the metallic area 11 with respect to the board with the inductive distance sensors. This change in distance is detected and is fed into an evaluation device (not shown). The evaluation device can be formed on the circuit board 8, or the signals of the inductive distance sensors can be fed to a separate evaluation unit.

Figure 5:
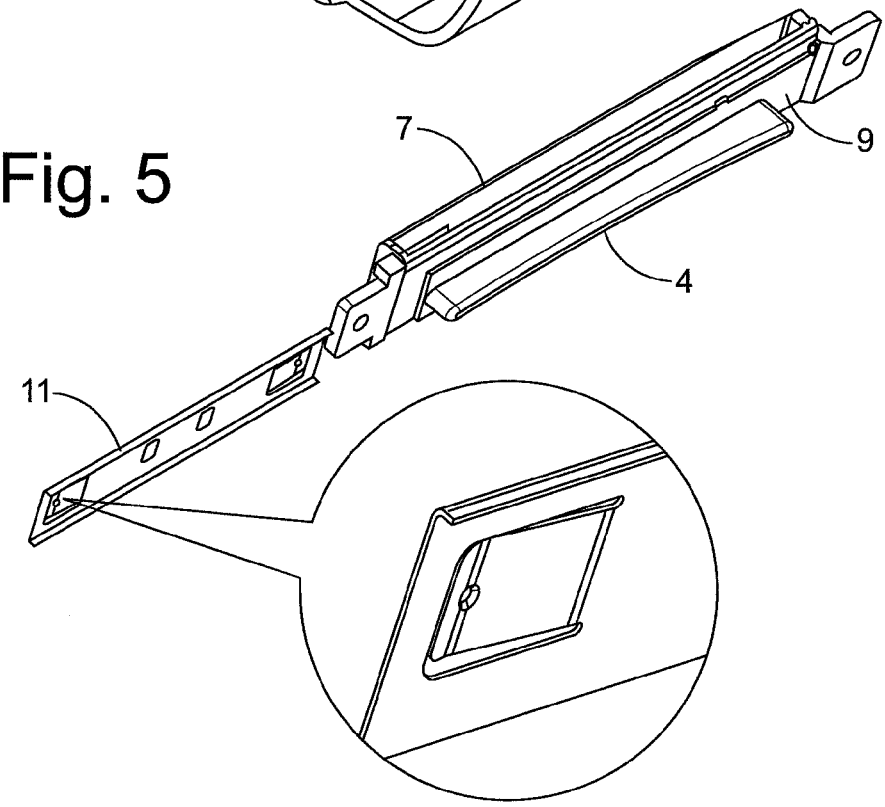
FIG. 5 shows a single representation of the actuating unit received in the handle.

FIG. 5 shows the operating unit with the receptacle 7, the tongue 9 and the projection 4, wherein the metallic part 11 of the actuating element is drawn away from the tongue 9. It can be seen that the metal part 11 has spring tongues 12, which support the tongue 9 against the receptacle 7 and provide a restoring force, which pushes back the projection 4 through the opening of the handle 3 to its original position when no force is exerted on the projection 4. The metallic part 11 thus has a double function, namely on the one hand to provide a restoring force and on the other hand to provide a means which is detected by the inductive distance sensors in the circuit 8.

The invention claimed is:

1. A vehicle door handle assembly including a sensor device for detection of an actuation, comprising:

a handle, wherein on a side of the handle adapted to be gripped from behind is arranged an actuating element, wherein the actuating element protrudes outward through a recess in the handle from an inner cavity of the handle through a wall of the handle over an outer contour of the handle, wherein the actuating element is accommodated inside the handle and is adapted to be shifted, tilted or deformed so as to be actuated, wherein the actuating element passes through the recess in a direction of the inner cavity of the handle against an elastic restoring force when a user grips the handle from behind exerting a force on the actuating element in the direction of the inner cavity when the handle is pulled, wherein the actuating element at least in sections comprises a metallic material, wherein inside the handle is arranged an electric module including an inductive distance sensor, wherein the inductive distance sensor is arranged stationary in the handle and spaced from the actuating element so that the distance of the actuating element in relation to the inductive distance sensor changes when the actuating element moves, wherein the inductive distance sensor detects a change in distance between the metallic material of the actuating element and the inductive distance sensor when the actuating element moves, wherein an evaluation unit detects signals produced by the inductive distance sensor and detects an actuation as a function of the signals and provides an output signal.

2. The vehicle door handle assembly according to claim 1, wherein the actuating element is made of a plastic, which is partially coated with a metallic layer.

3. The vehicle door handle assembly according to claim 1, wherein the electric module comprises a printed circuit board, on which is located the inductive distance sensor, wherein the printed circuit board is received in a holder, and wherein the actuating element is movably connected with the holder.

4. The vehicle door handle assembly according to claim 3, wherein the actuating element is formed integrally with the holder.

5. The vehicle door handle assembly according to claim 3, wherein the printed circuit board is potted with the distance sensor in the holder with a potting material.

6. The vehicle door handle assembly according to claim 1, wherein the actuating element is formed as an elongate element which extends along the longitudinal axis of the handle and wherein a plurality of inductive distance sensors are arranged along the longitudinal axis of the handle, which sensors detect the approach of various sections of the actuating element.

7. The vehicle door handle assembly according to claim 1, wherein the actuating element is formed of multiple parts, wherein a first section protruding from inside outward through the handle is made of a plastic and a metallic part as a second section is fixed inside the handle to the first section.

8. The vehicle door handle assembly according to claim 7, wherein the second section includes spring tongues, wherein the spring tongues are supported inside the handle to provide the restoring force of the actuating element.

9. The vehicle door handle assembly according to claim 7, wherein the first section of the actuating element is made of a transparent plastic and wherein inside the handle is arranged a light source, which conducts light into the first section, the first section being a light conductor that radiates light from the light source through the first section into the outer area of the handle.

10. The vehicle door handle assembly according to claim 4 wherein the actuating element comprises a deformable tongue.

* * * * *